US009902156B2

(12) United States Patent
Genta et al.

(10) Patent No.: US 9,902,156 B2
(45) Date of Patent: Feb. 27, 2018

(54) RECORDING DEVICE

(71) Applicant: CANON KABUSHIKI KAISHA, Tokyo (JP)

(72) Inventors: Shin Genta, Yokohama (JP); Masaya Uetsuki, Yokohama (JP); Toshimitsu Danzuka, Tokyo (JP); Kazuo Suzuki, Yokohama (JP); Yoshinori Nakagawa, Kawasaki (JP); Masataka Kato, Yokohama (JP); Tsuyoshi Ibe, Yokohama (JP); Tomoki Yamamuro, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/157,178

(22) Filed: May 17, 2016

(65) Prior Publication Data

US 2016/0339708 A1 Nov. 24, 2016

(30) Foreign Application Priority Data

May 19, 2015 (JP) ..... 2015-102295

(51) Int. Cl.
*B41J 2/165* (2006.01)

(52) U.S. Cl.
CPC ..... *B41J 2/16532* (2013.01); *B41J 2/1652* (2013.01); *B41J 2/16508* (2013.01); *B41J 2/16535* (2013.01); *B41J 2002/16573* (2013.01)

(58) Field of Classification Search
CPC ..... B41J 2/175; B41J 2/16532; B41J 2/17596
See application file for complete search history.

(56) References Cited

U.S. PATENT DOCUMENTS

2002/0060711 A1* 5/2002 Ito ..... B41J 2/16508 347/28
2002/0130917 A1* 9/2002 Mitsui ..... B41J 2/16508 347/29
2004/0212655 A1* 10/2004 Sasa ..... B41J 2/17513 347/30
2005/0052513 A1* 3/2005 Inoue ..... B41J 2/175 347/89

(Continued)

FOREIGN PATENT DOCUMENTS

JP 4-358846 A 12/1992
JP 2009-184149 A 8/2009

*Primary Examiner* — Stephen Meier
*Assistant Examiner* — John P Zimmermann
(74) *Attorney, Agent, or Firm* — Canon U.S.A., Inc. IP Division

(57) ABSTRACT

A recording device including a recording head, a tank, a valve capable of being switched between an open state where ink is supplied from the tank to the recording head and a closed state where the ink is not supplied, a cap covering a discharge port surface, a pump configured to make a pressure of an inside of the cap negative, an acquiring unit configured to acquire information on an atmospheric pressure of an environment where the recording device is placed, and a control unit configured to perform a suction operation of sucking the ink from the discharge port surface by driving the pump when the valve is in the closed state, making the pressure of the inside of the cap negative, and then switching the valve to the open state and to control the suction operation based on the acquired information.

8 Claims, 8 Drawing Sheets

(56) References Cited

U.S. PATENT DOCUMENTS

| | | | | |
|---|---|---|---|---|
| 2006/0279604 | A1* | 12/2006 | Ueda | B41J 2/19<br>347/36 |
| 2007/0040877 | A1* | 2/2007 | Kachi | B41J 2/17566<br>347/86 |
| 2009/0058915 | A1* | 3/2009 | Hayashi | B41J 2/16585<br>347/17 |
| 2010/0026739 | A1* | 2/2010 | Hirashima | B41J 2/16523<br>347/6 |
| 2010/0327025 | A1* | 12/2010 | Yokoyama | B41J 2/175<br>347/89 |
| 2012/0056933 | A1* | 3/2012 | Tanaka | B41J 2/16508<br>347/30 |
| 2013/0038650 | A1* | 2/2013 | Noda | B41J 29/38<br>347/9 |

* cited by examiner

FIG. 4A

| ALTITUDE | ATMOSPHERIC PRESSURE | ATMOSPHERIC PRESSURE ZONE | NUMBER OF SUCTION |
|---|---|---|---|
| 0 m TO UNDER 800 m | 1 atm – 0.9 atm | A | 2 TIMES |
| 800 m TO UNDER 1700 m | 0.9 atm – 0.8 atm | A | 2 TIMES |
| 1700 m TO UNDER 2500 m | 0.8 atm – 0.7 atm | B | 3 TIMES |
| 2500 m TO UNDER 3400 m | 0.7 atm – 0.6 atm | C | 4 TIMES |
| 3400 m TO UNDER 4200 m | 0.6 atm – 0.5 atm | C | 4 TIMES |
| 4200 m AND OVER | 0.5 atm – | C | 4 TIMES |

FIG. 4B

| ALTITUDE | ATMOSPHERIC PRESSURE | ATMOSPHERIC PRESSURE ZONE | PERIOD OF TIME FOR WHICH VALVE IS OPEN |
|---|---|---|---|
| 0 m TO UNDER 800 m | 1 atm – 0.9 atm | A | 3 s |
| 800 m TO UNDER 1700 m | 0.9 atm – 0.8 atm | A | 3 s |
| 1700 m TO UNDER 2500 m | 0.8 atm – 0.7 atm | B | 6 s |
| 2500 m TO UNDER 3400 m | 0.7 atm – 0.6 atm | C | 10 s |
| 3400 m TO UNDER 4200 m | 0.6 atm – 0.5 atm | C | 10 s |
| 4200 m AND OVER | 0.5 atm – | C | 10 s |

FIG. 4C

| ALTITUDE | ATMOSPHERIC PRESSURE | ATMOSPHERIC PRESSURE ZONE | DOT COUNT SUCTION THRESHOLD |
|---|---|---|---|
| 0 m TO UNDER 800 m | 1 atm – 0.9 atm | A | ×1 |
| 800 m TO UNDER 1700 m | 0.9 atm – 0.8 atm | A | ×1 |
| 1700 m TO UNDER 2500 m | 0.8 atm – 0.7 atm | B | ×0.75 |
| 2500 m TO UNDER 3400 m | 0.7 atm – 0.6 atm | C | ×0.5 |
| 3400 m TO UNDER 4200 m | 0.6 atm – 0.5 atm | C | ×0.5 |
| 4200 m AND OVER | 0.5 atm – | C | ×0.5 |

FIG. 4D

| ALTITUDE | ATMOSPHERIC PRESSURE | ATMOSPHERIC PRESSURE ZONE | TIMER SUCTION THRESHOLD |
|---|---|---|---|
| 0 m TO UNDER 800 m | 1 atm – 0.9 atm | A | ×1 |
| 800 m TO UNDER 1700 m | 0.9 atm – 0.8 atm | A | ×1 |
| 1700 m TO UNDER 2500 m | 0.8 atm – 0.7 atm | B | ×0.8 |
| 2500 m TO UNDER 3400 m | 0.7 atm – 0.6 atm | C | ×0.6 |
| 3400 m TO UNDER 4200 m | 0.6 atm – 0.5 atm | C | ×0.6 |
| 4200 m AND OVER | 0.5 atm – | C | ×0.6 |

RECORDING DEVICE

BACKGROUND

Field of the Disclosure

The present disclosure relates to an inkjet type recording device.

Description of the Related Art

Japanese Patent Laid-Open No. 2009-184149 discloses a technique for use in a recording device that fills a recording head with ink through a channel, such as a tube. This technique blocks the channel by using a blocking unit, making the inside of the channel have a predetermined negative pressure by using a suction unit, and then opening the channel to fill the recording head with the ink.

Japanese Patent Laid-Open No. 4-358846 discloses a technique of adjusting timing at which a discharge recovery unit is activated in accordance with a detected image recording amount to improve an ink discharge state of the recording head.

However, it is found that in the configuration described in Japanese Patent Laid-Open No. 2009-184149, when substantially the same suction operation is performed in an area with a high outside atmospheric pressure (for example, low altitude area) and in an area with a low outside atmospheric pressure (for example, high altitude area), the amount of ink filling in the area with the low outside atmospheric pressure is smaller. This is because in the area with the low outside atmospheric pressure, a pressure difference between a negative pressure inside the channel and recording head and the outside atmospheric pressure during the ink filling operation is small and the amount of ink that can be supplied to the recording head through the channel decreases. Accordingly, in the area with the low outside atmospheric pressure, when the recording head is filled with ink by a suction operation based on the assumption that the atmospheric pressure is normal, the recording head is not sufficiently filled with the ink and the amount of air inside the recording head is larger than expected. When air bubbles generated from the ink during the recording are accumulated in ink discharge ports, liquid path communicating therewith, or liquid chamber, ink non-discharge may occur at an early stage. One approach to this problem is setting the amount of ink sucked during ink filling at a rather large quantity in any pressure environment to achieve a sufficient amount of ink filling even in an area with a low outside atmospheric pressure. In this case, however, consumption of ink unnecessarily increases in an area with a high outside atmospheric pressure.

A similar problem may arise in the configuration described in Japanese Patent Laid-Open No. 4-358846. Specifically, in an area with a low outside atmospheric pressure, because the amount of air inside the recording head is larger than expected, air bubbles generated from the ink during the recording are larger than expected. This may cause ink non-discharge before a next recovery processing operation (suction operation). One approach to this problem is making timing at which a recovery processing operation is performed earlier in any atmospheric pressure environment to prevent the occurrence of ink non-discharge. In this case, however, in an area with a high outside atmospheric pressure, the recovery processing operation is performed in a state where a sufficient amount of ink still remains in the recording head and this results in an unnecessarily increased consumption of ink.

SUMMARY

The present disclosure provides a recording device capable of avoiding the occurrence of ink non-discharge caused by insufficiently filling a recording head with ink while suppressing an increase in ink consumption by controlling a suction operation based on information on an atmospheric pressure of an environment where the recording device is placed.

The present disclosure provides a recording device including a recording head, a tank, a valve, a cap, a pump, an acquiring unit, and a control unit. The recording head has a discharge port surface having a plurality of discharge ports that allow ink to be discharged therethrough. The tank is used for storing the ink to be supplied to the recording head. The valve is capable of being switched between an open state where the ink is supplied from the tank to the recording head and a closed state where the ink is not supplied from the tank to the recording head. The cap covers the discharge port surface. The pump is configured to make a pressure of an inside of the cap negative in a state where the cap covers the discharge port surface. The acquiring unit is configured to acquire information on an atmospheric pressure of an environment where the recording device is placed. The control unit is configured to perform a suction operation of sucking the ink from the discharge port surface by driving the pump when the valve is in the closed state, making the pressure of the inside of the cap negative, and then switching the valve to the open state. The control unit controls the suction operation based on the information acquired by the acquiring unit.

Further features of the present disclosure will become apparent from the following description of exemplary embodiments with reference to the attached drawings.

BRIEF DESCRIPTION OF THE DRAWINGS

FIGS. 4A to 4D illustrate a relationship between an outside atmospheric pressure environment and a suction operation according to embodiments of the present disclosure.

DESCRIPTION OF THE EMBODIMENTS

Figure 1:
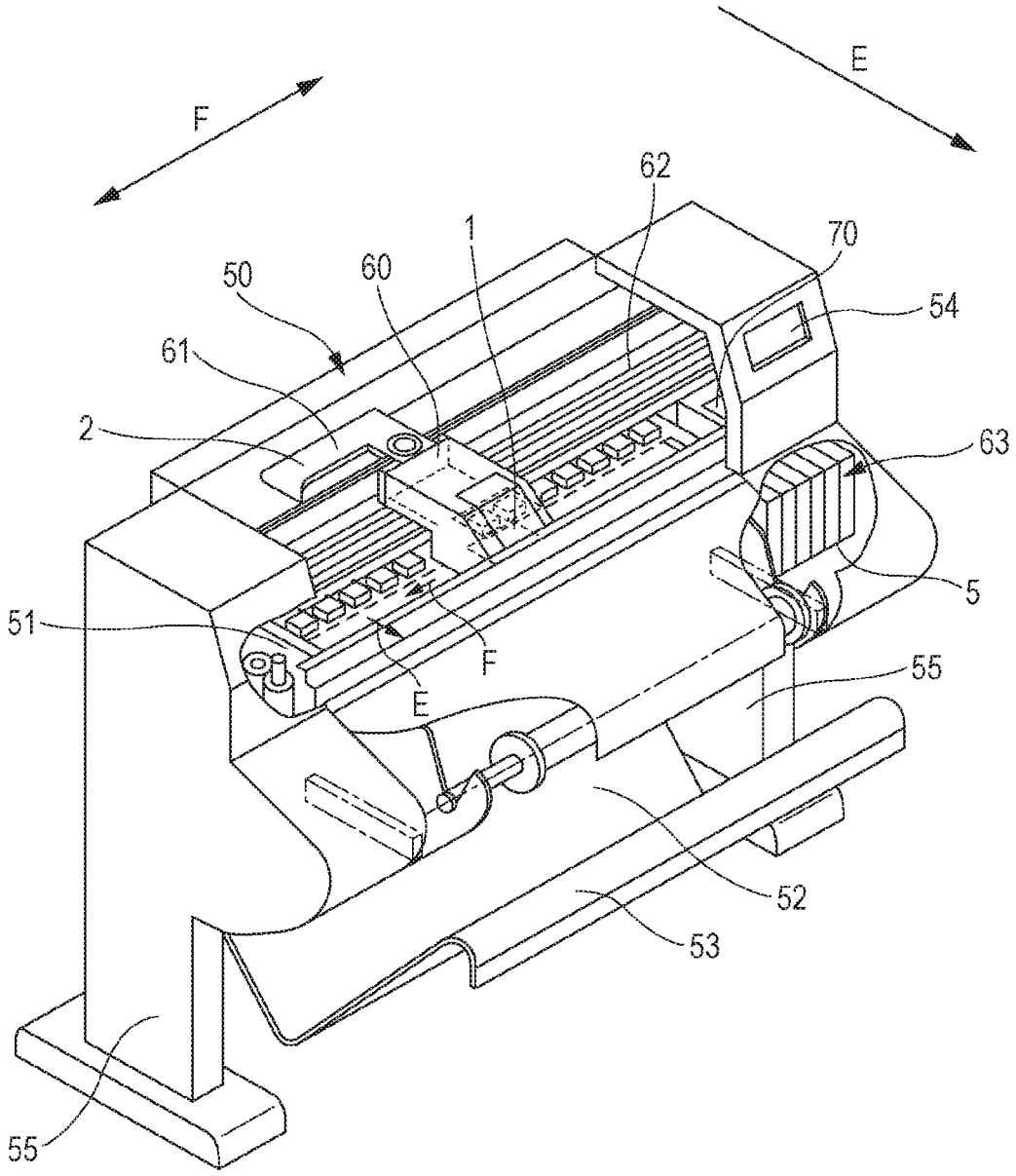
FIG. 1 is a perspective view of a recording device according to an embodiment of the present disclosure.

FIG. 1 is a perspective view of a recording device according to an embodiment of the present disclosure.

A recording device 50 is fixed such that it spans a gap between upper portions of two facing legs 55. A recording head 1 is mounted on a carriage 60. The carriage 60 is made to move reciprocally in a direction indicated by arrows F (F direction) by a carriage motor (not illustrated) and a belt transmitting unit 62. During this movement, ink droplets are discharged through nozzles in the recording head 1. An image for one band is recorded on a record medium (sheet) fed from a conveyance roll holder unit 52. When the carriage 60 moves to an end of the record medium, the record medium is conveyed by a predetermined amount in a direction indicated by an arrow E (E direction) by a conveyance roller 51. By repetition of alternately performing the recording operation and the conveying operation, an image is recorded on the entire record medium. After the completion of the recording operations, the record medium is cut by a cutter (not illustrated). The cut record media are loaded onto a stacker 53.

An ink supply unit 63 includes detachable ink tanks 5. The ink tanks 5 correspond to ink colors, such as black, cyan, magenta, and yellow. The ink tanks 5 are connected to supply tubes 2. The supply tubes 2 are tied to a tube guide 61 to prevent entanglement during the reciprocal movement of the carriage 60.

The recording head 1 has a nozzle surface (discharge port surface) where a plurality of nozzle arrays (illustration is omitted) are disposed in a location that faces the record medium. Each of the nozzle arrays consists of nozzles (discharge ports) allowing ink to be discharged therethrough and arranged along the E direction. The supply tubes 2 are connected for each nozzle array.

A recovery processing device 70 is disposed in a location that faces the nozzle surface of the recording head 1 outside a range of the record medium in the F direction. The recovery processing device 70 includes a cap 13 covering the nozzle surface and a pump 11 configured to make an inside pressure of the cap 13 negative in a state where the cap 13 covers the nozzle surface. The recovery processing device 70 performs a recovery processing operation (suction operation) for sucking ink from the nozzle surface of the recording head 1 by using the cap 13 and pump 11 and recovering a discharge performance of the recording head as needed. The recovery processing device 70 performs a valve closing suction operation, which is described below, by using the cap 13 and pump 11.

An operation panel 54 is disposed on the right side with respect to the recording device 50. The operation panel 54 issues a warning message when the ink tank 5 is empty of ink to prompt a user to replace the ink tank 5.

Figure 2:
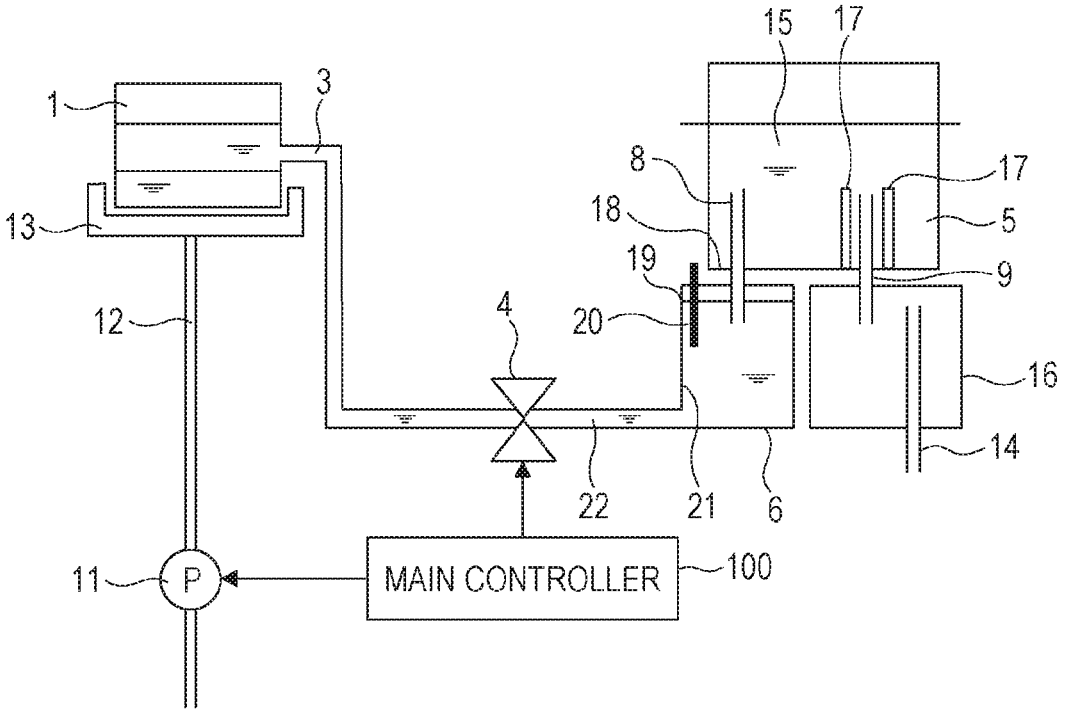
FIG. 2 is a conceptual illustration of an ink supply mechanism according to the embodiment of the present disclosure.

FIG. 2 is a concept illustration of an ink supply mechanism according to the embodiment of the present disclosure. The ink tank 5, which stores ink and is detachable, includes joint portions at two places in the bottom portion. The joint portions are connected to a first hollow tube 8 and a second hollow tube 9 in the recording device. A standing wall 17 standing on the bottom of the ink tank is disposed in the ink tank 5 in the vicinity of the second hollow tube 9. A minute constant current is made to flow through the first hollow tube 8 and second hollow tube 9. When the height of a liquid surface of the ink in the ink tank 5 is lower than the standing wall 17, a voltage value required to make a current flow increases, and this enables detection of an ink remaining amount in the ink tank 5. The second hollow tube 9 communicates with an air communication chamber 16. The ink tank 5 communicates with the air through an air communication passage 14 in the air communication chamber 16. The ink tank 5 communicates with a reservoir tank 6 through the first hollow tube 8, which extends through a bottom surface 18 of the ink tank 5 and a top surface 19 of the reservoir tank 6. The reservoir tank 6 communicates with the recording head 1 through an ink passage 3. A metallic pin 20 is disposed in the reservoir tank 6. The ink remaining amount in the reservoir tank 6 can be detected from a voltage value required to cause a weak constant current to flow to the first hollow tube 8 and metallic pin 20. An ink supply port for use in supplying the ink from the reservoir tank 6 to the recording head 1 is in a lowest location 22 of a side surface 21 of the reservoir tank 6. An opening/closing valve 4 is disposed on the ink passage 3, which extends between the reservoir tank 6 and recording head 1. The opening/closing valve 4 can be switched between an open state where the ink can be supplied from the reservoir tank 6 to the recording head 1 and a closed state where the ink cannot be supplied from the reservoir tank 6 to the recording head 1.

Next, a valve closing suction operation is described. First, the state is brought into a closed state where the ink passage 3 is blocked by the opening/closing valve 4, which is positioned along the ink passage 3. Then, the recovery processing device 70 drives the pump 11 in a state where the cap 13 covers the nozzle surface and sucks the air inside the cap 13. It continues the suction for a predetermined period of time to make the pressure of the inside of the cap 13 negative. After that, it stops driving the pump 11 and then switches the opening/closing valve 4 to the open state and opens the ink passage 3. In this way, the ink is supplied from the ink tank 5 to the recording head 1, and the recording head 1 is filled with a predetermined amount of ink. This valve closing suction operation is performed during early stage ink filing. It is also performed during the recovery processing operation for removing the air inside the recording head 1 and recovering the recording performance. In the early stage filling, when mounting of the ink tank 5 on a mounting portion (or main body of the device) is detected, the valve closing suction operation is performed multiple times. After that, filling the reservoir tank is controlled, and the ink is supplied from the reservoir tank 6 to the recording head 1.

Figure 3:
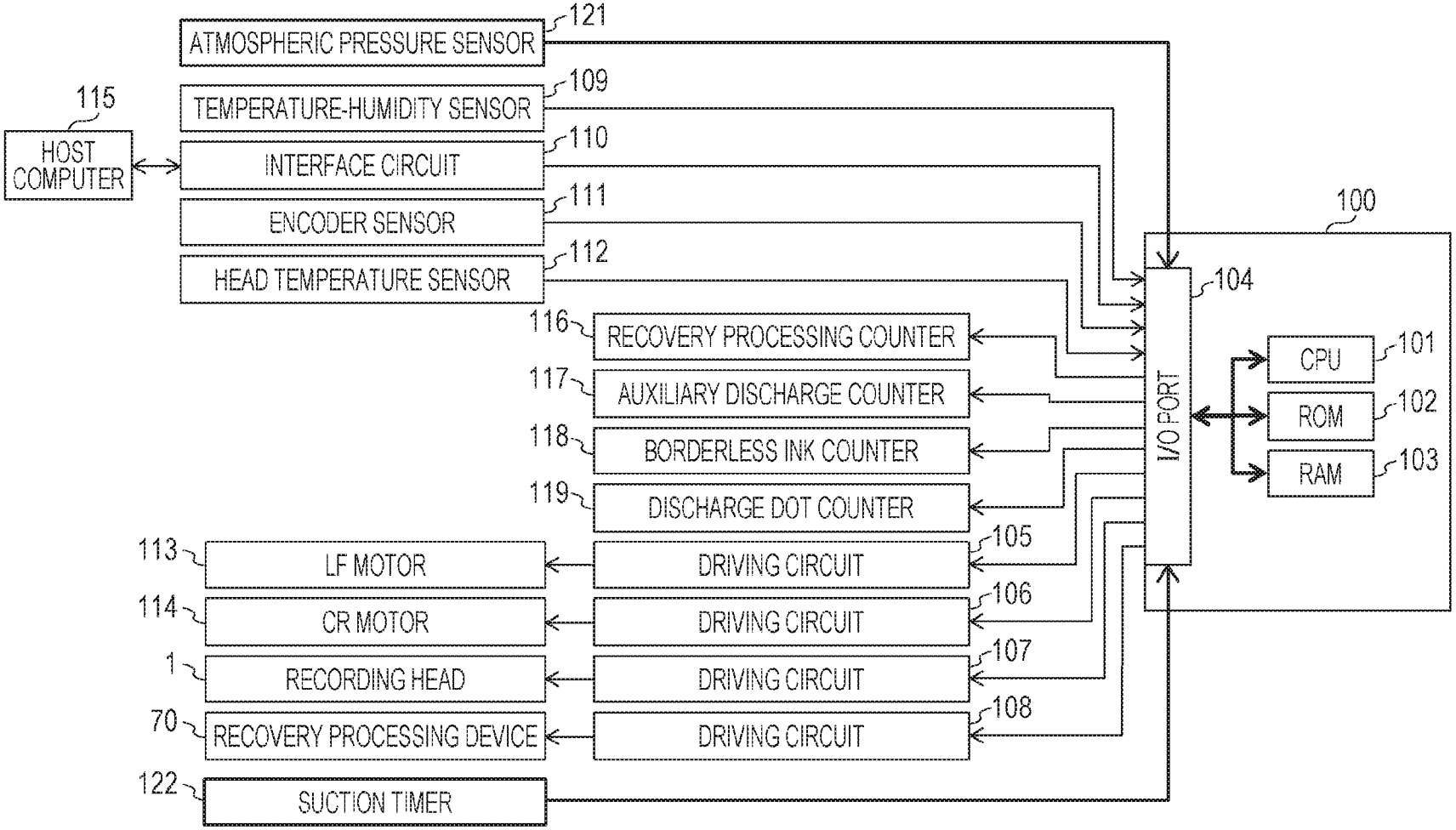
FIG. 3 is a block diagram that illustrates a configuration of a control system in the recording device according to the embodiment of the present disclosure.

FIG. 3 is a block diagram that illustrates a configuration of a control system in the recording device according to the embodiment of the present disclosure. A main controller 100 includes a central processing unit (CPU) 101 configured to perform processing operations, such as calculation, controlling, determination, and setting, and a read-only memory (ROM) 102 that stores control programs to be executed by the CPU 101 and other data. The main controller 100 includes a random-access memory (RAM) 103 used as a buffer that stores binary recording data indicating discharge/non-discharge of ink, a work area used for processing performed by the CPU 101 or other areas. The main controller 100 includes an input/output port 104.

The input/output port 104 is connected to a conveyance motor (LF motor) 113 configured to drive a conveying unit, a carriage motor (CR motor) 114 configured to drive the carriage, driving circuits 105, 106, 107, and 108 for the recording head 1, recovery processing device 70, and other components. The input/output port 104 is connected to a head temperature sensor 112 configured to sense a temperature of the recording head 1, an encoder sensor 111 fixed on the carriage 60, and a temperature-humidity sensor 109 configured to sense a temperature and humidity of an environment where the recording device 50 is used. The input/output port 104 is connected to other sensors, including an atmospheric pressure sensor 121 configured to sense an outside atmospheric pressure. The main controller 100 is connected to a host computer 115 through an interface circuit 110.

A recovery processing counter 116 measures the amount of ink when the recovery processing device 70 sucks the ink from the recording head 1. An auxiliary discharge counter 117 measures the amount of ink when the ink is discharged from the recording head 1 in an auxiliary manner. A borderless ink counter 118 measures the amount of ink discharged outside the area of the record medium when borderless recording is performed. A discharge dot counter 119 measures the amount of ink discharged during recording. A suction timer 122 determines an elapsed time (measured time) from completion of the recovery processing operation for the recording head 1.

The position of the carriage 60 is detected by the main controller 100 counting pulse signals output from the encoder sensor 111 during movement of the carriage 60. That is, the encoder sensor 111 detects slits arranged at constant intervals on an encoder film (not illustrated) disposed along the F direction and outputs pulse signals to the main controller 100. The main controller 100 counts the pulse signals and detects the position of the carriage 60. Movements of the carriage 60 to a home position and other positions are based on signals from the encoder sensor 111.

First Embodiment

A first embodiment of the present disclosure is described below with reference to FIGS. 4A and 5. In the present embodiment, the valve closing suction operation in filling the recording head 1 with ink is mainly described.

FIG. 4A is an illustration that describes the number of suction operations corresponding to an outside atmospheric pressure environment. The number of suction described here is the number of repetitions of the above-described valve closing suction operation. First, information on the outside atmospheric pressure for the recording device 50 (outside atmospheric pressure information) is acquired at a certain timing, such as an initial installation time or time before the start of a filling operation. In the present embodiment, the atmospheric pressure is acquired by using the atmospheric pressure sensor 121. Any information from which the atmospheric pressure can be inferred may be acquired. Examples of such information may include information on the altitude, latitude/longitude, or regional name. The information can be acquired from a device, such as a global positioning system (GPS), or by another way, such as by receiving a direct input from a user through the operation panel 54.

Next, the acquired outside atmospheric pressure information is stored in the RAM 103 through the input/output port 104. Here, with reference to the table in FIG. 4A, among atmospheric pressure zones (in this example, three zones: A, B, and C), the atmospheric pressure zone corresponding to the environment where the recording device is placed is determined from the stored outside atmospheric pressure information. In a case where information on the altitude is acquired, the outside atmospheric pressure is inferred from the altitude, and its corresponding atmospheric pressure zone is determined in substantially the same manner. Here, once the atmospheric pressure zone is determined, the number of suction operations is uniquely determined. For example, when the acquired outside atmospheric pressure is in the range of 0.8 atm to 0.7 atm, the suction operation is performed three times. When the acquired outside atmospheric pressure is in the range of 0.7 atm to 0.6 atm, the suction operation is performed four times. For example, when the altitude is in the range of 1700 m to under 2500 m, the suction operation is performed three times. When the altitude is in the range of 2500 m to under 3400 m, the suction operation is performed four times. In this manner, the number of suction is set at a value that reduces with an increase in the outside atmospheric pressure, and conversely, it is set at a value that increases with a reduction in the outside atmospheric pressure. That is, in an area with a lower outside atmospheric pressure, where insufficient ink filling may occur, a sufficient amount of ink filling is achieved by setting the number of suction at an increased value. The correspondence between the atmospheric pressure information and the number of suction described here is merely an example for illustrative purposes, and other examples may also be used.

Next, a sequence of the ink filling operation according to the present embodiment is described.

Figure 5:
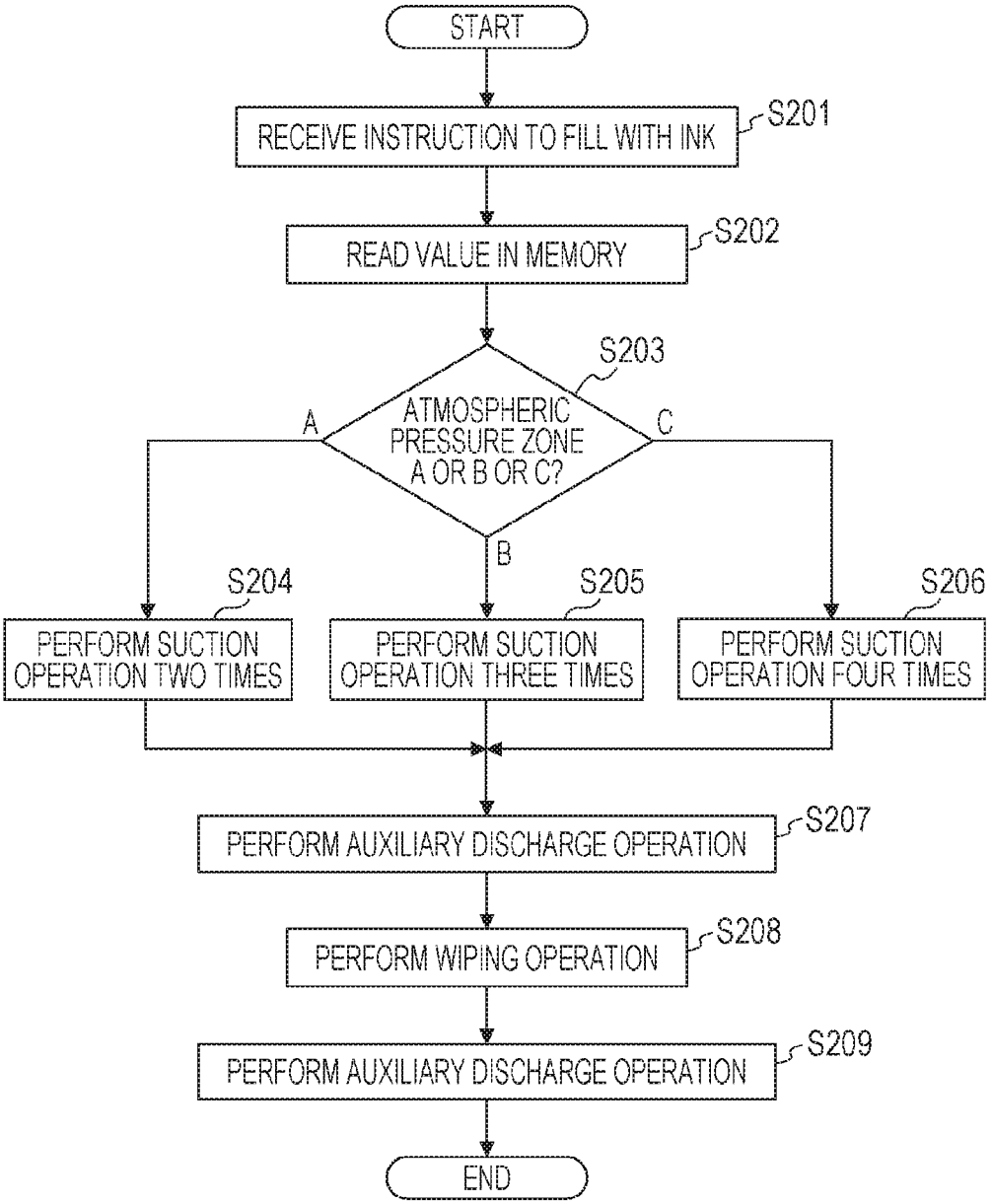
FIG. 5 is a flowchart describing a procedure in an ink filling operation according to a first embodiment.

FIG. 5 is a flowchart for describing a procedure in the ink filling operation according to the present embodiment. When an instruction to fill the recording head 1 with ink is received from the recording device 50 (S201), the information on the atmospheric pressure stored in the RAM 103 is acquired (S202). Next, the CPU 101 determines the atmospheric pressure zone corresponding to the environment where the recording device 50 is placed (S203). Then, the valve closing suction operation is performed the number of times corresponding to the determined atmospheric pressure zone (S204-S206). After the completion of the valve closing suction operation the predetermined number of times, an auxiliary discharge operation for preventing color mixing is performed (S207). Then, a wiping operation for wiping ink off the nozzle surface is performed (S208). Lastly, the auxiliary discharge operation is performed (S209), and the sequence ends.

As described above, according to the present embodiment, by setting the number of times the suction operation is performed based on information on the atmospheric pressure of the environment where the recording device is placed, ink non-discharge caused by insufficiently filling the recording head with the ink can be avoided while suppressing an increase in the ink consumption and the suction time period.

Second Embodiment

A second embodiment of the present disclosure is described with reference to FIGS. 4B and 6. In the present embodiment, controlling for adjusting the period of time for which the opening/closing valve 4 is open in the valve closing suction operation in filling the recording head 1 with the ink is mainly described.

FIG. 4B is an illustration that describes a period of time for which the opening/closing valve 4 is open corresponding to an outside atmospheric pressure environment. The period of time for which the opening/closing valve 4 is open described here is the period of time for which the opening/closing valve 4 is open after the ink passage 3 is blocked by the opening/closing valve 4 and the pressure is made to be a predetermined negative pressure in the above-described valve closing suction operation.

In the present embodiment, like in the first embodiment, outside atmospheric pressure information for the recording device 50 is first acquired at a certain timing, such as an initial installation time or time before the start of a filling operation. Next, the acquired outside atmospheric pressure information is stored in the RAM 103 through the input/output port 104. Here, with reference to the table in FIG. 4B, among atmospheric pressure zones (in this example, three zones: A, B, and C), the atmospheric pressure zone corresponding to the environment where the recording device is placed is determined from the stored outside atmospheric pressure information. In a case where information on the altitude is acquired, the outside atmospheric pressure is inferred from the altitude, and its corresponding atmospheric pressure zone is determined in substantially the same manner. Here, once the atmospheric pressure zone is determined, the period of time for which the opening/closing valve 4 is open is uniquely determined. For example, when the acquired outside atmospheric pressure is in the range of 0.8 atm to 0.7 atm, the valve open time period is set at 6 s. When the acquired outside atmospheric pressure is in the range of 0.7 atm to 0.6 atm, the valve open time period is set at 10 s. For example, when the altitude is in the range of 1700 m to under 2500 m, the valve open time period is set at 6 s. When the altitude is in the range of 2500 m to under 3400 m, the valve open time period is set at 10 s. In this manner, the valve open time period is set at a value that reduces with an increase in the outside atmospheric pressure, and conversely, it is set at a value that increases with a reduction in the outside atmospheric pressure. The correspondence between the atmospheric pressure information and the valve open time period described here is merely an example for illustrative purposes, and other examples may also be used.

In the present embodiment, the valve open time period is adjusted in accordance with the atmospheric pressure without changing the number of suction. In a case where the opening/closing valve 4 is open, at an early stage in the valve open time period, the amount of ink supplied from the ink tank 5 to the recording head 1 is large. As time goes by, the amount of ink supplied from the ink tank 5 to the recording head 1 reduces. Although such a tendency, the amount of ink supplied can be increased by an increase in the valve open time period in an area with a low outside atmospheric pressure. As described above, because the amount of ink supplied is defined by a pressure difference between the set negative pressure and outside atmospheric pressure, the amount of ink supplied in a low outside atmospheric pressure case is smaller than that in a normal atmospheric pressure case, even at an early stage in the valve open time period. Accordingly, by setting the valve open time period at a value that increases with a reduction in the outside atmospheric pressure, the decrease in the amount of ink caused by insufficient supply at an early stage in the valve open time period can be compensated for in the remaining period of time.

Next, a sequence of the ink filling operation according to the present embodiment is described.

Figure 6:
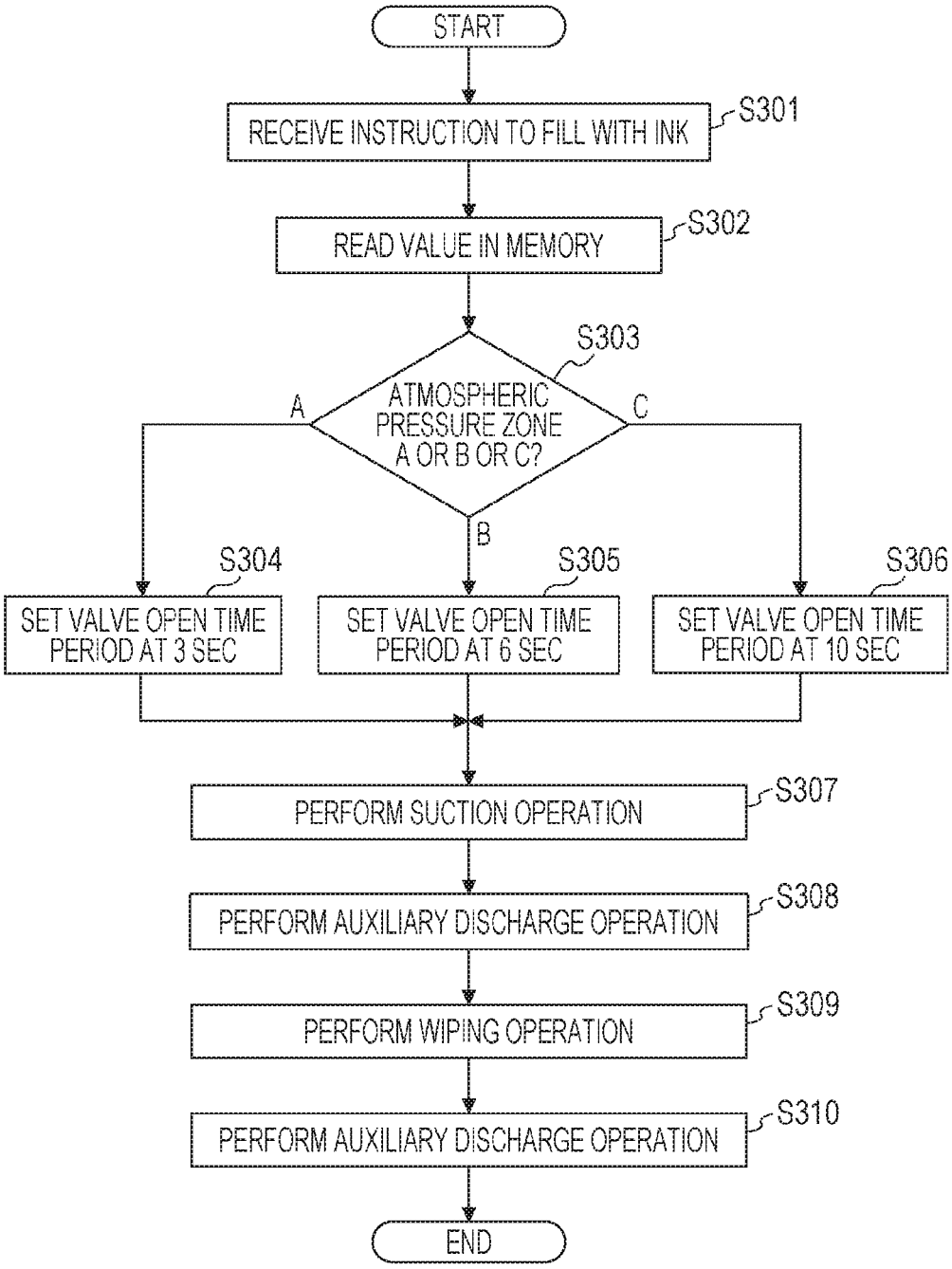
FIG. 6 is a flowchart describing a procedure in an ink filling operation according to a second embodiment.

FIG. 6 is a flowchart for describing a procedure in the ink filling operation according to the present embodiment. When an instruction to fill the recording head 1 with ink is received from the recording device 50 (S301), the information on the atmospheric pressure in the RAM 103 is acquired (S302). Next, the CPU 101 determines the atmospheric pressure zone corresponding to the environment where the recording device 50 is placed (S303). Then, the valve open time period in the valve closing suction operation is set at a value corresponding to the atmospheric pressure zone (S304-S306). Next, the valve closing suction operation corresponding to the set valve open time period is performed (S307). After that, the auxiliary discharge operation for preventing color mixing is performed (S308). Then, the wiping operation for wiping ink off the nozzle surface is performed (S309). Lastly, the auxiliary discharge operation is performed (S310), and the sequence ends.

As described above, according to the present embodiment, by setting the valve open time period in the suction operation based on information on the atmospheric pressure of the environment where the recording device is placed, ink non-discharge caused by insufficiently filling the recording head with the ink can be avoided while suppressing an increase in the consumption of ink and the suction time period.

Third Embodiment

A third embodiment of the present disclosure is described with reference to FIGS. 4C and 7. In the present embodiment, controlling for adjusting timing at which the recovery processing operation (suction operation) for removing air bubbles from the recording head is performed is mainly described.

FIG. 4C is an illustration that describes setting a dot count suction threshold in accordance with the outside atmospheric pressure environment. The dot count suction threshold described here is an image recording amount as a criterion for the timing at which the recovery processing operation is performed. That is, when the image recording amount measured by the discharge dot counter 119 is at or above the threshold (ink discharge amount is at or above a predetermined amount), the recovery processing device 70 performs the recovery processing operation.

In the present embodiment, like in the first embodiment, outside atmospheric pressure information for the recording device 50 is first acquired at a certain timing, such as an initial installation time or time before the start of a filling operation. Next, the acquired outside atmospheric pressure information is stored in the RAM 103 through the input/output port 104. Here, with reference to the table in FIG. 4C, among atmospheric pressure zones (in this example, three zones: A, B, and C), the atmospheric pressure zone corresponding to the environment where the recording device is placed is determined from the stored outside atmospheric pressure information. In a case where information on the altitude is acquired, the outside atmospheric pressure is inferred from the altitude, and its corresponding atmospheric pressure zone is determined in substantially the same manner. Here, once the atmospheric pressure zone is determined, the dot count suction threshold is uniquely determined. For example, when the acquired outside atmospheric pressure is in the range of 0.8 atm to 0.7 atm, the dot count suction threshold is set at a valve 0.75 times an original numerical value. When the acquired outside atmospheric pressure is in the range of 0.7 atm to 0.6 atm, the dot count suction threshold is set at a valve 0.5 times the original numerical value. For example, when the altitude is in the range of 1700 m to under 2500 m, the dot count suction threshold is set at a valve 0.75 times the original numerical value. When the altitude is in the range of 2500 m to under 3400 m, the dot count suction threshold is set at a valve 0.5 times the original numerical value. In this manner, the timing is set later as the outside atmospheric pressure increases, and conversely, it is set earlier as the outside atmospheric pressure decreases. That is, by making the timing at which the recovery processing operation is performed earlier in a lower pressure state where ink non-discharge may occur at an early time because of insufficient ink filling or generation of air bubbles during printing, defective discharge from the recording head 1 can be prevented. The correspondence between the atmospheric pressure information and the dot count suction threshold described here is merely an example for illustrative purposes, and other examples may also be used.

Next, a sequence of the recovery processing operation according to the present embodiment is described.

Figure 7:
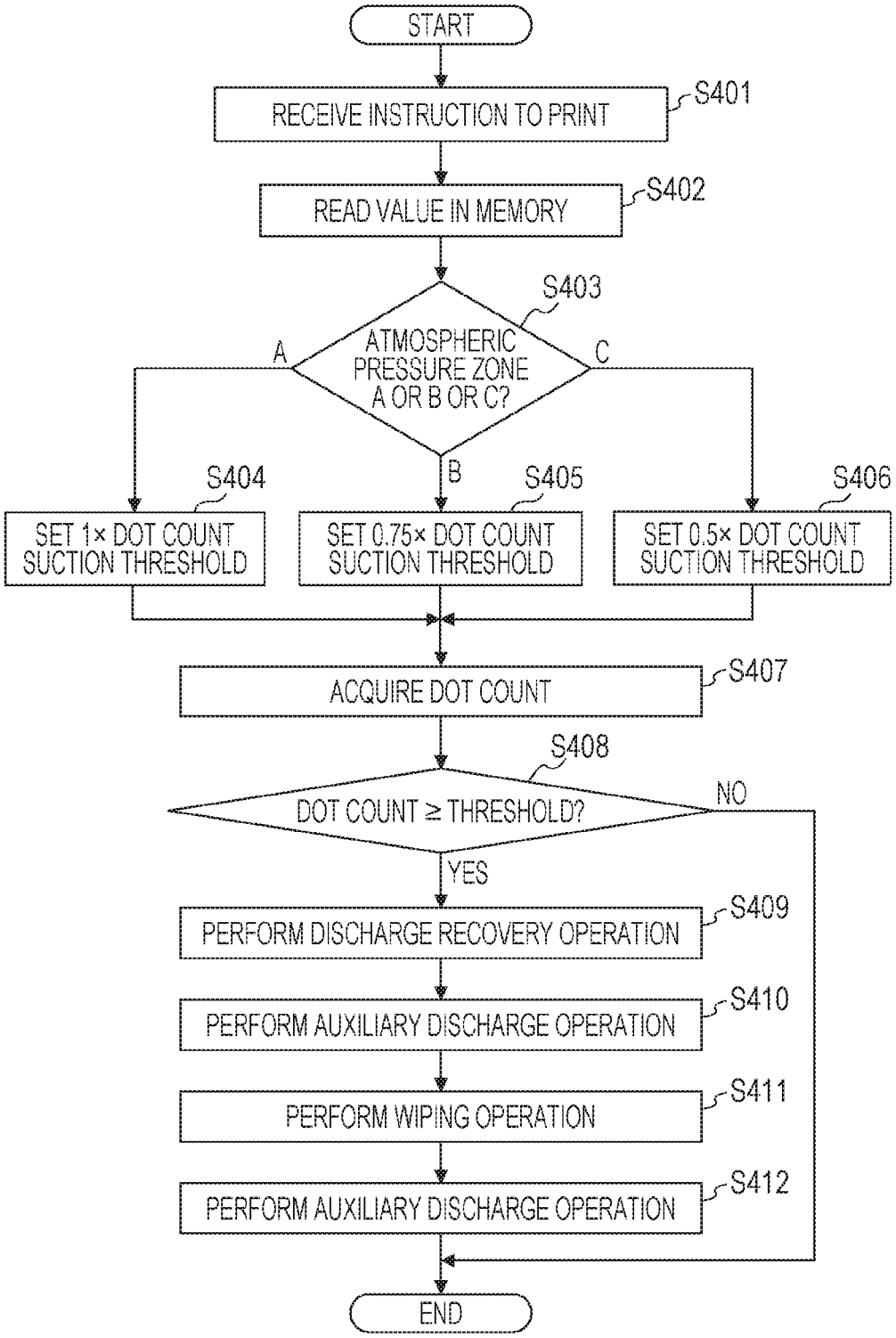
FIG. 7 is a flowchart describing a procedure in a recovery processing operation according to a third embodiment.

FIG. 7 is a flowchart for describing a procedure in the recovery processing operation according to the present embodiment. When an instruction to perform printing is received from the recording device 50 (S401), the information on the atmospheric pressure stored in the RAM 103 is acquired (S402). Next, the CPU 101 determines the atmospheric pressure zone corresponding to the environment where the recording device 50 is placed (S403). Then, the dot count suction threshold is set at a valve corresponding to the atmospheric pressure zone (S404-S406). Next, a present image recording amount is acquired from the discharge dot counter 119 (S407). The acquired image recording amount is compared with the previously set dot count suction threshold (S408). When the acquired image recording amount is at or above the dot count suction threshold, the recovery processing device 70 performs the recovery processing operation (S409). Then, the auxiliary discharge operation for preventing color mixing is performed (S410). After that, the wiping operation for wiping ink off the nozzle surface is performed (S411). Lastly, the auxiliary discharge operation is performed (S412), and the sequence ends. At S408, when the acquired image recording amount is below the dot count suction threshold, the sequence ends.

As described above, according to the present embodiment, by setting the dot count suction threshold based on information on the atmospheric pressure of the environment where the recording device is placed, ink non-discharge caused by insufficiently filling the recording head with the ink can be avoided while suppressing an increase in the consumption of ink.

Fourth Embodiment

A fourth embodiment of the present disclosure is described with reference to FIGS. 4D and 8. In the present embodiment, controlling for adjusting timing at which a next recovery processing operation is performed in a case where the next recovery processing operation is performed based on an elapsed time from the immediately preceding recovery processing operation (suction operation) for the recording head 1 is mainly described.

FIG. 4D is an illustration that describes setting a timer suction threshold in accordance with the outside atmospheric pressure environment. The timer suction threshold described here is a time period (predetermined time period) as a criterion for the time period from the immediately preceding recovery processing operation to the next recovery processing operation. That is, when an elapsed time (measured time) from the immediately preceding recovery processing operation measured by the suction timer 122 is at or above the predetermined time period, the recovery processing device 70 performs the next recovery processing operation.

In the present embodiment, like in the first embodiment, outside atmospheric pressure information for the recording device 50 is first acquired at a certain timing, such as an initial installation time or time before the start of a filling operation. Next, the acquired outside atmospheric pressure information is stored in the RAM 103 through the input/output port 104. Here, with reference to the table in FIG. 4D, among atmospheric pressure zones (in this example, three zones: A, B, and C), the atmospheric pressure zone corresponding to the environment where the recording device is placed is determined from the stored outside atmospheric pressure information. In a case where information on the altitude is acquired, the outside atmospheric pressure is inferred from the altitude, and its corresponding atmospheric pressure zone is determined in substantially the same manner. Here, once the atmospheric pressure zone is determined, the timer suction threshold is uniquely determined. For example, when the acquired outside atmospheric pressure is in the range of 0.7 atm to 0.8 atm, the timer suction threshold is set at a valve 0.8 times an original numerical value. When the acquired outside atmospheric pressure is in the range of 0.7 atm to 0.6 atm, the timer suction threshold is set at a valve 0.6 times the original numerical value. For example, when the altitude is in the range of 1700 m to under 2500 m, the timer suction threshold is set at a valve 0.8 times the original numerical value. When the altitude is in the range of 2500 m to under 3400 m, the timer suction threshold is set at a valve 0.6 times the original numerical value. In this manner, the timing at which the next recovery processing operation is performed is set earlier as the outside atmospheric pressure reduces. That is, by making the timing at which the next recovery processing operation is performed earlier in a lower pressure state where ink non-discharge may occur at an early time because of insufficient ink filling or generation of air bubbles during printing, defective discharge from the recording head 1 can be prevented. The correspondence between the atmospheric pressure information and the timer suction threshold described here is merely an example for illustrative purposes, and other examples may also be used.

Next, a sequence of the recovery processing operation according to the present embodiment is described.

Figure 8:
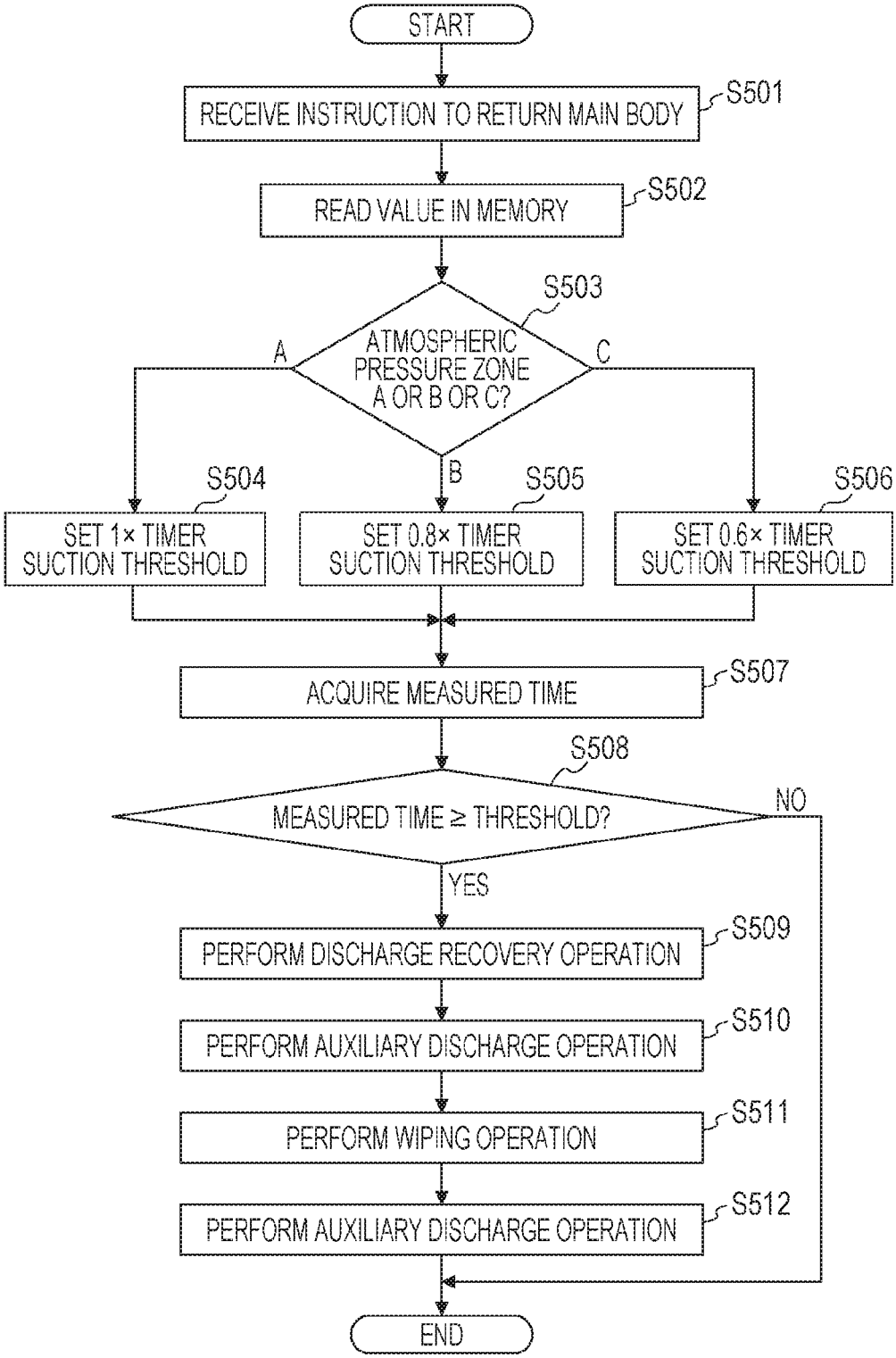
FIG. 8 is a flowchart describing a procedure in a recovery processing operation according to a fourth embodiment.

FIG. 8 is a flowchart for describing a procedure in the recovery processing operation according to the present embodiment. When an instruction to return the recording device 50 (S501), the information on the atmospheric pressure stored in the RAM 103 is acquired (S502). Next, the CPU 101 determines the atmospheric pressure zone corresponding to the environment where the recording device 50 is placed (S503). Then, the timer suction threshold is set at a valve corresponding to the atmospheric pressure zone (S504-S506). Next, the elapsed time from the immediately preceding recovery processing operation is acquired from the suction timer 122 (S507). The acquired elapsed time is compared with the previously set timer suction threshold (S508). When the acquired elapsed time is at or above the timer suction threshold, the recovery processing device 70 performs the recovery processing operation (S509). Then, the auxiliary discharge operation for preventing color mixing is performed (S510). After that, the wiping operation for wiping ink off the nozzle surface is performed (S511). Lastly, the auxiliary discharge operation is performed (S512), and the sequence ends. At S508, when the acquired elapsed time is below the timer suction threshold, the sequence ends.

As described above, according to the present embodiment, by setting the timer suction threshold based on information on the atmospheric pressure of the environment where the recording device is placed, ink non-discharge caused by insufficiently filling the recording head with the ink can be avoided while suppressing an increase in the consumption of ink.

As described above, according to the present disclosure, by controlling the suction operation based on information on the atmospheric pressure of the environment where the recording device is placed, ink non-discharge caused by insufficiently filling the recording head with the ink can be avoided while suppressing an increase in the consumption of ink.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-102295, filed May 19, 2015, which is hereby incorporated by reference herein in its entirety.

What is claimed is:

1. A recording device comprising:

a recording head having a discharge port surface having a plurality of discharge ports that allow ink to be discharged therethrough;

a first tank for storing the ink to be supplied to the recording head;

a second tank for storing the ink to be supplied to the first tank;

an ink-flow path for supplying the ink from the first tank to the recording head;

a valve disposed on the ink-flow path and capable of being switched between an open state where the ink is supplied from the second tank to the recording head through the first tank and a closed state where the ink is not supplied from the second tank to the recording head;

a cap configured to cover the discharge port surface;

a pump configured to make a pressure of an inside of the cap negative in a state where the cap covers the discharge port surface;

an acquiring unit configured to acquire information on an ambient air pressure of an environment where the recording device is placed; and a suction control unit configured to perform a suction operation of sucking the ink from the discharge ports by driving the pump when the valve is in the closed state and then switching the valve to the open state, wherein when a predetermined instruction is received, the suction control unit performs the suction operation twice or more in a first case where the ambient air pressure acquired by the acquiring unit is larger than a threshold, and the suction control unit performs the suction operation a larger number of times in a second case where the ambient air pressure acquired by the acquiring unit is smaller than the threshold than in the first case.

2. The recording device according to claim 1, wherein the suction operation sucks the ink from the discharge ports by driving the pump when the valve is in the closed state, then stopping the pump, and then switching the valve to the open state.

3. The recording device according to claim 1, wherein after performing the suction operation, the control unit performs an auxiliary discharge operation of discharging the ink through the discharge ports in an auxiliary manner and a wiping operation of wiping the discharge port surface.

4. The recording device according to claim 1, wherein the acquiring unit includes an atmospheric pressure sensor, and the acquiring unit acquires the information on the ambient air pressure based on a result of detection by the atmospheric pressure sensor.

5. The recording device according to claim 1, wherein the acquiring unit includes a global positioning system (GPS), and the acquiring unit acquires the information on the ambient air pressure based on information acquired by the GPS.

6. The recording device according to claim 5, wherein the information acquired by the GPS includes altitude, latitude or longitude of the environment where the recording device is placed.

7. The recording device according to claim 1, wherein the acquiring unit includes an operation panel, and the acquiring unit acquires the information on the ambient air pressure based on input information input to the operation panel by a user.

8. The recording device according to claim 7, wherein the input information includes a regional name of the environment where the recording device is placed.

* * * * *